United States Patent [19]

Wilson

[11] Patent Number: 4,493,976

[45] Date of Patent: Jan. 15, 1985

[54] PYROLYTIC OVEN CLEANING SYSTEM

[75] Inventor: Arthur C. Wilson, Louisville, Ky.

[73] Assignee: General Electric Company, Louisville, Ky.

[21] Appl. No.: 490,326

[22] Filed: May 2, 1983

[51] Int. Cl.[3] ..... F24C 15/32; A21B 1/22; F27D 11/02

[52] U.S. Cl. ..... 219/398; 126/21 R; 219/395; 219/413

[58] Field of Search ..... 219/391, 395, 396, 398, 219/397, 413; 126/21 A, 21 R

[56] References Cited

U.S. PATENT DOCUMENTS

| | | | |
|---|---|---|---|
| 3,059,089 | 10/1962 | Swisher | 219/391 |
| 3,336,465 | 8/1967 | Hurko | 219/397 |
| 3,668,371 | 6/1972 | Fry | 219/397 |
| 3,875,372 | 4/1975 | Gilliom | 219/413 |
| 3,962,561 | 6/1976 | Maitenaz | 219/391 |

*Primary Examiner*—Roy N. Envall, Jr.

*Assistant Examiner*—Teresa J. Walberg

*Attorney, Agent, or Firm*—Frank P. Giacalone; Radford M. Reams

[57] ABSTRACT

A cooking oven of the heat-cleaning type in which substantially all of the energy for heating the oven to heat-cleaning temperature is initially supplied by the upper or broil heating element. The broil unit is initially energized to raise the oven cavity temperature to the heat cleaning range during which time volatile portions of food by-products are evaporated, whereupon the broil unit is de-energized and the lower or bake heating element energized to maintain the temperature of the oven cavity in the heat cleaning range. The location of the lower bake unit relative to the lower wall of the oven cavity is dimensioned to insure that the temperature of the more difficult to clean front portion of the lower wall of the oven adjacent the door opening is maintained at heat-cleaning temperature for a time sufficient to effect removal of food by-products.

4 Claims, 4 Drawing Figures

15
19
22
B
C
39
21
56
54
57
20
17
18
24
45
49
51
47
48
52
46
16
88
A
3
50
53

PYROLYTIC OVEN CLEANING SYSTEM

BACKGROUND OF THE INVENTION

This invention relates to self-cleaning ovens using a pyrolytic process at a high temperature range above normal cooking temperatures, between about 750° F. and about 950° F. of the type fully disclosed in U.S. Pat. No. 3,121,158 assigned to General Electric Company, the assignee of the present invention. In such high temperature oven-cleaning operations, it is best to maintain the oven wall temperature at substantially uniform temperatures throughout so as to avoid hot spots which may damage the oven liner, and also cold spots which would cause soil or food by-product deposits to remain or not be fully decomposed. With regard to cold spots, it should be noted that heat tends to be dissipated through and around the oven door at a higher rate than at other areas of the oven. One of the causes of heat dissipation is that in some heat cleaning oven designs air for decomposition of food by-products, as well as conventional baking, is allowed to enter the oven cavity through the door seal area and, more particularly, between the lower edge portion of the door and oven cavity. It has been common practice in self-cleaning ovens of the type disclosed in U.S. Pat. No. 3,121,158 to incorporate a mullion heater to supply additional heat adjacent the front of the oven liner to replenish this heat loss. While the additional heat source has been effective in preventing cold spots and insuring uniform cleaning of the oven walls, the employment of the additional heater adds considerably to the cost of the ovens. This is reflected not only in the cost of the additional heating element employed but also in the higher cost of fabricating the additional members and assembling them. Other methods of preventing heat loss or cooling of the oven liner adjacent the oven opening are typically disclosed in U.S. Pat. Nos. 3,066,212 and 3,038,426 wherein the oven liner is thermally isolated from the surrounding cabinet.

SUMMARY OF THE INVENTION

A heat-cleaning oven is provided wherein food by-products are pyrolytically decomposed in an oven cavity including vertical side walls, top, bottom and vertical rear walls, and a front opening for access to the oven. A door is pivotally connected adjacent the lower portion of the oven for movement between a closed position and an open position relative to the front opening. The oven is heated by a broil or top heating element and/or a bake or lower heating element for establishing cooking operation, as well as the high temperature heat cleaning operation. The oven temperature control is operable in the cooking temperature range to control the energization of the heating elements to effect the cooking operation, and also operable in the heat cleaning range to control the heating element to effect the self-cleaning operation of the oven cavity. A control is selectively operable to control the heating element to effect the high temperature heat-cleaning operation by initially energizing the broil unit until the temperature of the oven cavity is in a heat-cleaning temperature range of between about 750° F. and about 950° F. and to then maintain the oven at the heat-cleaning temperature by de-energizing the broil unit and energizing the bake unit. The temperature of the walls of the oven, and more particularly the bottom wall, during the remainder of the heat-cleaning operation is maintained through energization of the bake heating element.

An object of the present invention, therefore, is to provide a self-cleaning oven wherein the distribution of heat is controlled in a manner which maintains the oven wall temperature at substantially uniform temperatures during the heat-cleaning process.

Another objects of the present invention is to control operation of the broil and bake heating elements in a manner that insures that the temperature of the generally most difficult to clean bottom wall of the oven is maintained at a temperature sufficient to insure decomposition of food by-products.

Another object of the present invention is to provide an air passage into the oven in an area less susceptible to the cooling effect of the inlet air and resulting in poor cleanability.

DESCRIPTION OF THE PREFERRED EMBODIMENT

Figure 1:
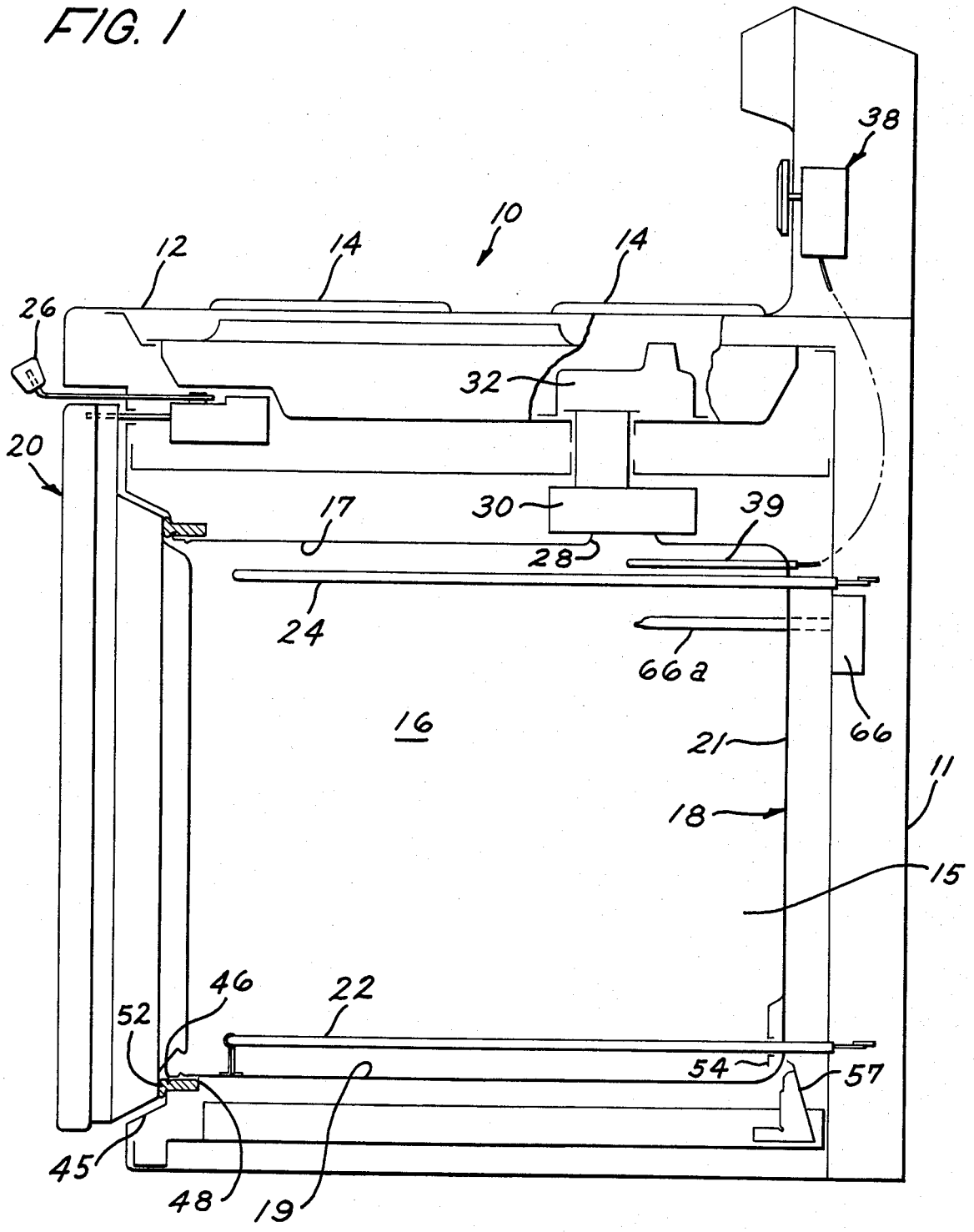
FIG. 1 is a schematic fragmentary side elevational view of an electric self-cleaning range embodying the present invention.

Referring to the drawings and more particularly to FIG. 1, there is shown for illustrative purposes a free standing electric range 10. While a free standing oven is presently shown, it should be understood that the invention may be applied to any heat-cleaning oven. The range 10 generally includes an outer cabinet 11 which includes a top cooking surface or cooktop 12 with a plurality of surface heating units 14. Positioned in the cabinet 11 is an oven cavity 16 formed by a box-like oven liner 18 having vertical side walls 15, top wall 17, bottom wall 19, rear wall 21 and a front opening drop door 20. The oven cavity 16 is supplied with the usual sources of heat energy; namely, two electric resistance heating elements in the form of a lower baking element 22 positioned in close proximity to and in a plane substantially parallel to the lower wall 19, and an upper broiling element 24 positioned in the upper portion of cavity 16.

Other elements illustrated in the drawing but which do not form a part of the present invention will be discussed here briefly for ease in understanding the environment of the present invention. To this end a door latch handle 26 which is used for locking the oven door 20 is conveniently located for positioning in a heat-cleaning or lock mode during the high temperature heat-cleaning operation. The oven cavity 16 is provided with a venting system having an exhaust duct 28 mounted on the top wall 17 of the oven cavity liner so that the gaseous degradative products formed during the pyrolytic cleaning cycle may be exhausted to the outside of the oven. The vent system also aids in temperature distribution and avoidance of the accumulation of moisture generated during the normal cooking process. Interposed in this exhaust duct 28 is oxidation unit 30 which serves both as a smoke and odor eliminator.

There is an exhaust or evacuation conduit 32 from the unit 30 which discharges beneath one of the surface heating units.

A standard oven thermostatic control system 38 comprises a temperature sensor such as a probe 39 which is mounted so as to project into the oven cavity 16. The probe 39 is connected to an electric responder (not shown) that may be arranged as shown in the range backsplash. In the present embodiment, the thermostate 38 controls the temperature of the oven in the normal cooking range of between 150° F. and 500° F. by cycling the heating unit(s) in a manner that insures that the selected temperature is not exceeded, and also controls the temperature of the oven in the heat-cleaning range of between about 750° F. and about 950° F. to insure that the maximum heat-cleaning temperature is not exceeded.

Figures 2, 3:
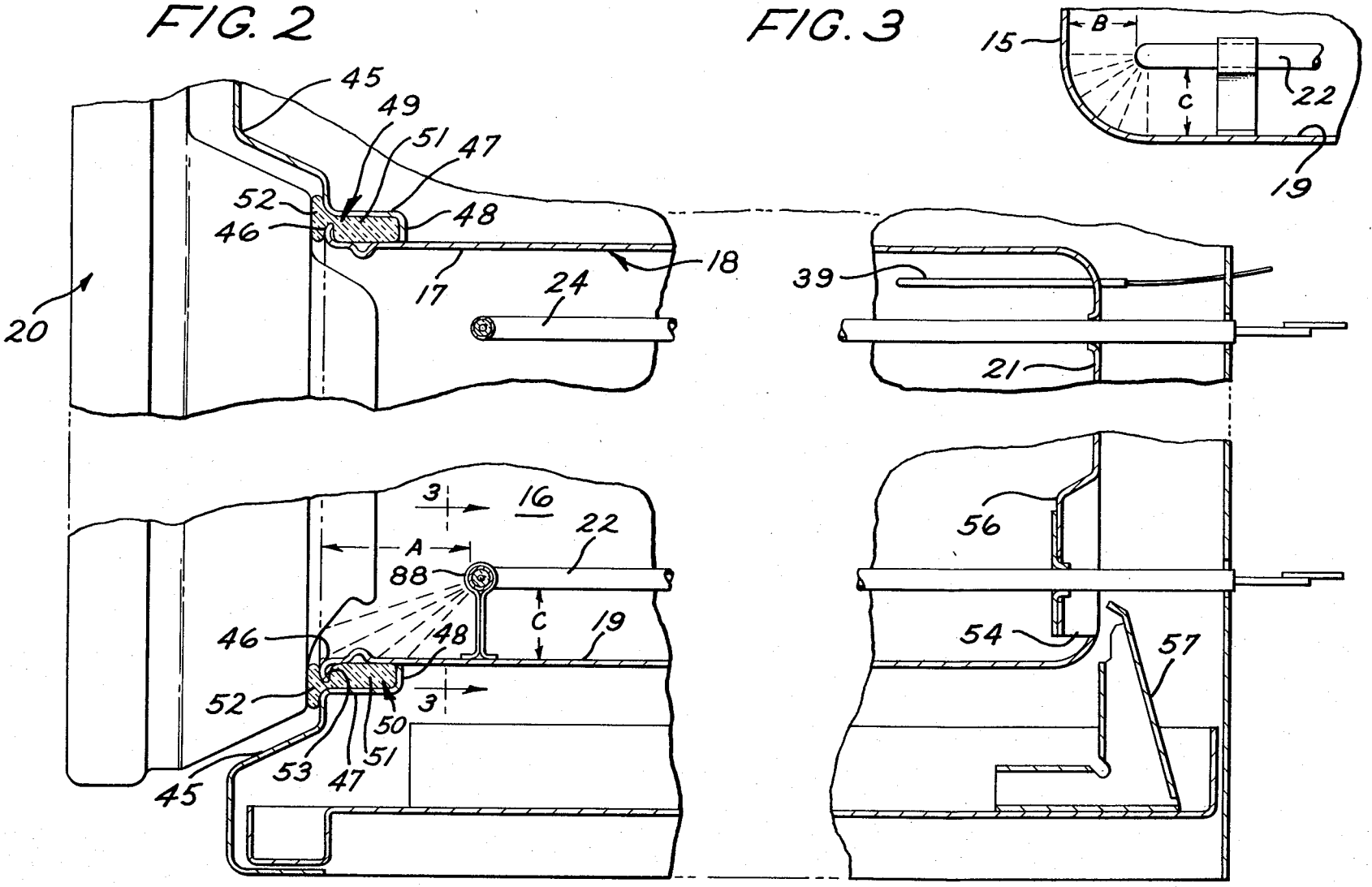
FIG. 2 is an enlarged fragmentary side elevational view in section showing the details of the present invention in relation to range oven and door.
FIG. 3 is a fragmentary sectional view taken along line 3—3 of FIG. 2.

With reference now to FIG. 2, it will be seen that the oven opening is defined by a door frame member 45 which is formed to at least partially receive the door 20. The front edge of the oven liner 18 is formed to provide an outwardly directed annular lip or flange 46 which may be formed as shown by rolling over the distal front edge of the oven liner. The frame 45 includes an annular rearwardly projecting portion 47 which is substantially parallel to the bottom wall 19 of the liner 18. The liner 18 is located and spaced from the portion 47 by an inwardly projecting locating flange 48 formed as part of the frame 45 so as to provide a space 49 between the wall 19 and portion 47.

Both an air seal or gasket between the door 20 and front opening, and a breaker strip between the oven liner and frame are provided by a member 50 having a relatively low K factor, such as a flexible glass fiber woven gasket which is current state of the art.

In the present embodiment as mentioned above, there is combined a breaker strip and door gasket into the one annular member 50. The annular member 50 has a breaker strip portion 51 interposed in the peripheral space 49 between the portion 47 and the walls of liner 18. A door gasket portion 52 of the member 50 is defined on the front portion thereof by an annular groove 53 which is dimensioned to receive the liner front flange portion 46. The gasket portion 52 extends generally forward of the flange 46 and frame 45 to form an annular door gasket between the door and the oven cavity opening which effectively seals the oven from outside air.

It should be noted that it is necessary to provide a supply of oxygen for the combustion of the exhaust gases within the oxidation unit 30. This oxygen is supplied by creating a gentle sweep of room air through the oven cavity. To this end, the rear wall of the oven cavity 18 is formed to include an opening 54 for the admission of fresh air to the inside of the oven. The opening 54 is formed by a duct-like projection 56 that may be formed on the rear wall. The projection 56 supports the terminal end of the bake unit 22. The air entering the oven cavity through opening 54 passes over the relatively hot terminal end of bake unit 22 and is thus pre-heated during both the heat-cleaning and normal cooking operations, thereby preventing the influx of cold air. The outside ambient air is directed toward the opening 54 by a deflector member 57 that is positioned between the oven liner and outer cabinet. Fumes or food by-products from inside the oven, particularly those which are produced during cleaning, are carried by the movement of incoming air into the catalytic oxidation unit 30 and are then passed through the evacuation conduit 32 at the top of the range where they are evacuated, in the embodiment shown, through the surface heating unit.

It has been determined that during the normal cooking operation of a range, most of the soil or food by-products remain on the lower wall of the oven, and more particularly the front edge portion thereof. Since the bulk of the food by-products are present on the lower wall, this is generally the most difficult portion of the oven to clean, and attention is therefore directed to this area. As mentioned hereinbefore, in the past one method of solving this problem has been to provide an auxiliary or mullion heater.

By the present invention, means are provided for controlling energization of the heating elements 22 and 24 during the heat-cleaning operation. In accordance with the present invention, means are provided to insure that the lower wall 19 of the oven is maintained at a temperature sufficient to remove substantially all of the food by-products. To this end, a heat-cleaning, thermally-responsive switch 66 is provided which, as will be explained, insures that the lower or bake unit is energized during the heat-cleaning operation. The switch 66 includes a probe **66*a*** which is arranged to sense the temperature of the oven cavity.

Figure 4:
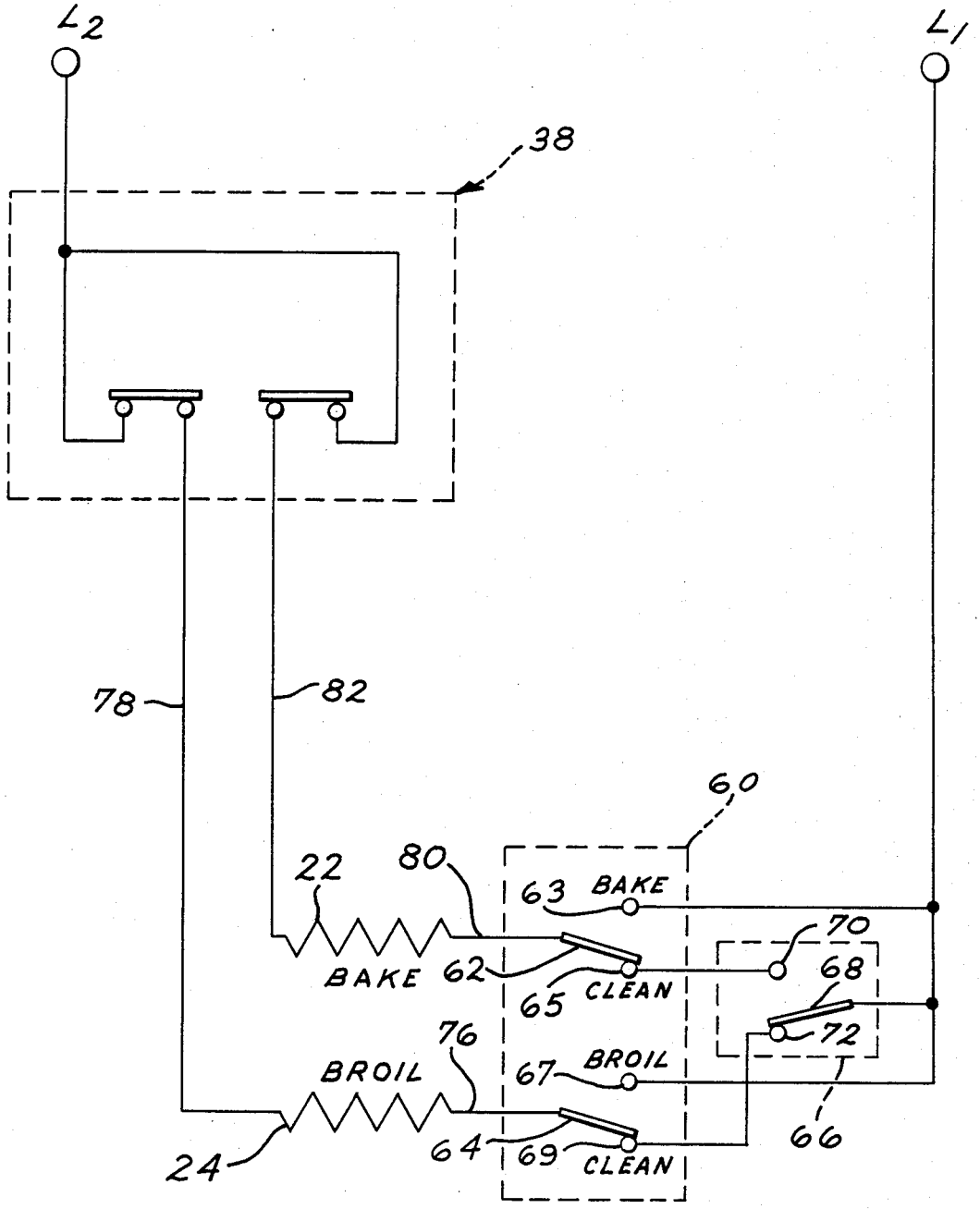
FIG. 4 is a schematic wiring diagram of the control circuit for controlling operation of the oven heating elements.

With reference to FIG. 4, there is shown a control circuit which prevents over-heating of the oven cavity by controlling operation of the broil and bake heating elements 24 and 22, respectively, through the thermostat 38 both in the heat-cleaning and normal cooking operation. Power is supplied through a pair of live wires L1 and L2 to the electrical load of the oven which is made up of the bake element 22 and the broil element 24. In effect, the thermostat system cycles the heater so that the selected cooking temperature is not exceeded in the normal cooking range of between 150° F. and 500° F., and also cycles the heating element so that selected heat-cleaning temperature is not exceeded in the heat-cleaning range of between 750° F. and 950° F. To this end, an operation selector switch 60 is provided which is conventional in the art. The selection switch 60 may include, as shown in the present embodiment, two switches 62 and 64 that in the heat-cleaning selection are positioned so that in the normal cooking operation a circuit to the bake and broil heating units is completed therethrough from line L1, and in the heat-cleaning position the circuit to the heating element is completed through the heat-cleaning thermal switch 66. The switch 62 is movable between a contact 63 for normal bake operation to a contact 65 for the heat-cleaning operation. While the switch 64 is movable between a contact 67 for normal broil operation to a contact 69 for the heat-cleaning operation.

In the heat-cleaning operation, line voltage to the heating elements 22, 24 passes through the heat-cleaning thermal switch 66. The switch 66 includes a temperature responsive switch member 68 movable between stationary contacts 70 and 72 under influence of the temperature sensed by the probe **66*a*. The movable switch 68 at the start of the heat-cleaning operation is at its normal position as shown with member 68 in engagement with contact 72. In this position, the line voltage passes through switch member 68 and contact 72 energizing the broil element 24 through line 76, then through line 78 to the system thermostat 38 and then completes the circuit to line L2. When the temperature of the oven reaches the heat-cleaning temperature of between about 750° F. and about 950° F., the thermal responsive member 68 of switch 66 moves to engage contact 70. At this time, the broil element is de-energized and a circuit is completed through line 80, bake element 22, line 82 and thermostat 38** to line L2. From this point on in the self-cleaning operation, the circuit for maintaining the oven at heat-cleaning temperature is effective through the bake element.

While the means for switching from the broil heating element to the bake heating element is accomplished by a thermal responsive switch, it should be apparent to one skilled in the art that the controlling factor in carrying out the present invention is that this switching between heating elements occurs rather than the exact manner in carrying out. Another way of accomplishing the same result would be to effect the switching from the broil heating element to the bake heating element as a function of time. In this instance, a period of time may be selected when it is determined that the oven will be in the heat-cleaning temperature range, after which switching to the bake heating element would take place. Other methods may be employed such as cycle counting at clean temperatures, after which switching would take place.

The maintenance of temperature control in the heat-cleaning range by use of the bake unit insures that the lower wall 19 of the oven remains at the self-cleaning temperature. This is critical since, as mentioned above, the most difficult area of the oven to clean is generally the lower wall portion of the oven and, more particularly, the front edge portion of the front wall and the lower front ends of the side wall adjacent the lower wall.

To further insure that these difficult lower front wall portions of the oven and maintained at self-cleaning temperatures, the bake unit is configured so that the leading front portion is positioned as shown in FIG. 2 adjacent the front lower end of the door and front portion of the bottom wall. As indicated by broken lines in FIGS. 2 and 3, the bake unit is located so that heat from the front end thereof radiates to the lower front portion of the oven and, accordingly, insures that the self-cleaning temperatures as maintained in that area.

With reference to FIGS. 2 and 3, it should be understood by one skilled in the art that the location of the front portion 88 of the bake unit is so positioned relative to the front edge portion of the bottom wall 19 that the heat radiated by the front portion of the heat element 22, as shown by broken lines, is sufficient to maintain the selected portion of the lower wall 19 and side walls 15 within the heat-cleaning temperature range. The exact spacing of the unit relative to the front lower wall portion will vary depending on various parameters such as wattage or heat output of the heating element and temperature range selected. However, the distance must be selected to insure that the radiated heat is sufficient to effectively remove or decompose all of the food by-products from this general area.

The removal of substantially all of the food by-products from the oven all surfaces was carried out by employing a bake heating element having a wattage rating of between 2,500–3,000 at 250 v. with the leading edge 88 positioned, as indicated A in FIG. 2, between 1.312 and 1.875 inches from the front edge of the bottom wall 19, and, as indicated C, the heating element was spaced approximately 1.08 inches from the bottom wall 19. The dimension indicated B between the heating element and the lower portion of the side wall was approximately between 1.18 and 1.45 inches.

In summary, the present invention by first energizing the broil heating element results in a gradual evaporization of the volatile portions of the food by-products to take place during the initial portion of the heat-cleaning operation and prior to the energization of the bake heating element. It should be noted that due to its close proximity to the bottom wall of the oven the high radiation of heat caused by energization of the bake heating element prior to this drying out period could, depending on the amount and type of food by-product accumulation, result in an overlaod of the oxidation unit. In effect, by the present invention, the bake heating element is energized after a period of time that is sufficient to cause evaporization of the volatile portion of food by-products.

The foregoing is a description of the preferred embodiment of the apparatus and method of the invention, and it should be understood that variations may be made thereto without departing from the true spirit and scope of the invention as defined in the appended claims.

What is claimed is:

1. A heating-cleaning oven in which food is cooked during a cooking operation and the food by-products to be removed are pyrolytically decomposed during a high temperature cleaning operation, comprising:

a housing defining an oven cavity having vertical side walls, top, bottom and vertical rear walls, and an open front opening for access to the cavity of the oven, a door pivotally connected adjacent a lower portion of said oven cavity for movement between a generally vertical closed position and a generally horizontal open position;

a first heating means arranged adjacent the top wall of said cavity and a second heating means arranged adjacent the bottom wall of said oven for establishing said cooking operation, as well as said second heating means including a front portion arranged in spaced relationship in an area of said bottom wall adjacent said front opening, said front portion being arranged a distance from said area effective to maintain said area at a temperature sufficient to pyrolytically decompose said food by-products from said area during said high temperature heat cleaning operation;

an oven temperature control means including means operable at cooking temperature ranges for controlling energization of said heating means during cooking operation of said oven and means operable at high test cleaning temperature range for controlling energization of said heating means during heat cleaning operations;

control means for said heating means selectively operable to control the heating means to effect the high temperature heat cleaning operation and means for energizing said first heating means to raise the temperature of said oven interior to a heat-cleaning temperature range of between about 750° and about 950° and for de-energizing said first heating means when said oven is in said heat-cleaning range and for energizing said second heating means to insure that said heat-cleaning temperature range is maintained in said area of said bottom wall adjacent said front opening of said oven during said heat cleaning operation.

2. A heat-cleaning oven recited in claim 1 wherein said control means includes a temperature responsive switch means movable for completing a circuit for energizing said first heating means until the temperature within said oven is in a heat-cleaning temperature range between about 750° F. and about 950° F. and movable for de-energizing said first heating means when said oven is in said heat-cleaning range for completing a circuit for energizing said second heating means.

3. A heat cleaning oven recited in claim 1 wherein said second heating means is positioned relative to said front opening so that the heat radiated by said second heating means along the front opening defined by said lower wall and at least a portion of said front opening defined by the lower portion of said side walls is sufficient to decompose food by-products therefrom.

4. A heat cleaning oven recited in claim 1 further including duct means located adjacent the lower rear portion of said cavity for admitting air by convection flow into said cavity to supply oxygen for promoting the pyrolytic decomposition of food by-products, said second heating means including a terminal end portion extending through said lower portion of said cavity being positioned in said duct means so that said air flowing into said cavity through said duct means is heated.

* * * * *

UNITED STATES PATENT AND TRADEMARK OFFICE

CERTIFICATE OF CORRECTION

PATENT NO. : 4,493,976

DATED : January 15, 1985

INVENTOR(S) : Arthur C. Wilson

It is certified that error appears in the above-identified patent and that said Letters Patent is hereby corrected as shown below:

Column 6, line 53, "test" should read --heat--.

Signed and Sealed this

*Twenty-eighth* Day of *May 1985*

[SEAL]

*Attest:*

DONALD J. QUIGG

*Attesting Officer*

*Acting Commissioner of Patents and Trademarks*